United States Patent [19]

Hutchison

[11] 4,038,763

[45] Aug. 2, 1977

[54] ORBITAL TRENCH FORMING APPARATUS

[76] Inventor: Marion Edward Hutchison, 1241 Ackermant, Waterloo, Iowa 50703

[21] Appl. No.: 621,492

[22] Filed: Oct. 10, 1975

[51] Int. Cl.[2] ..... E02F 5/02; E02F 9/28

[52] U.S. Cl. ..... 37/80 R; 37/141 R; 37/142 R; 37/DIG. 18; 83/751; 83/778; 172/40; 299/38

[58] Field of Search ..... 37/DIG. 18, 80 R, 86, 37/193, 88, 141 R, 142 R, 80; 172/40, 54, 84, 86, 88, 101, 102; 299/37, 38, 14, 83, 88; 61/72.5, 72.6; 83/746, 751, 758, 778, 769, 773; 30/369, 393

[56] References Cited

U.S. PATENT DOCUMENTS

| | | | |
|---|---|---|---|
| 774,102 | 11/1904 | Payne | 37/88 |
| 1,726,863 | 9/1929 | Singer | 30/369 |
| 3,326,010 | 6/1967 | Gagne | 61/72.6 |
| 3,647,003 | 3/1972 | Gagne | 37/193 X |
| 3,685,591 | 8/1972 | Ulrich et al. | 37/193 |
| 3,914,948 | 10/1975 | Kaercher, Jr. | 37/193 X |

FOREIGN PATENT DOCUMENTS

| | | | |
|---|---|---|---|
| 1,038,324 | 9/1958 | Germany | 37/80 R |
| 109,341 | 1/1899 | Germany | 299/88 |
| 629,544 | 5/1936 | Germany | 61/72.6 |
| 1,124,649 | 8/1968 | United Kingdom | 299/37 |
| 164,843 | 8/1963 | U.S.S.R. | 37/80 R |

*Primary Examiner*—Edgar S. Burr
*Assistant Examiner*—Steven A. Bratlie
*Attorney, Agent, or Firm*—Henderson, Strom and Sturm

[57] ABSTRACT

A trenching apparatus of a type for use particularly in hard or discontinuous soils. First and second triangular members, having digging teeth connected to the leading edges thereof, are connected to the housing by three crank assemblies. One of the crank assemblies is coupled to the motor for turning the crank and thereby oscillating the first and second members. One of the crank assemblies is a timing crank for establishing the proper relative movement between the first and second members so that the orbital motion of the first and second members are 180° out of phase.

19 Claims, 16 Drawing Figures

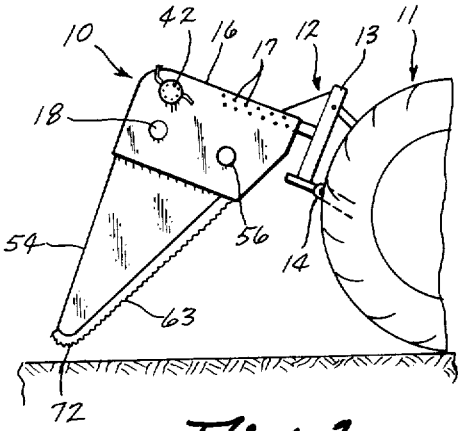
Fig. 1
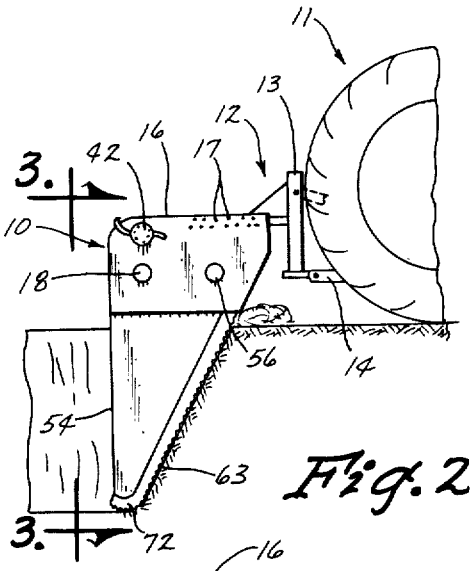
Fig. 2
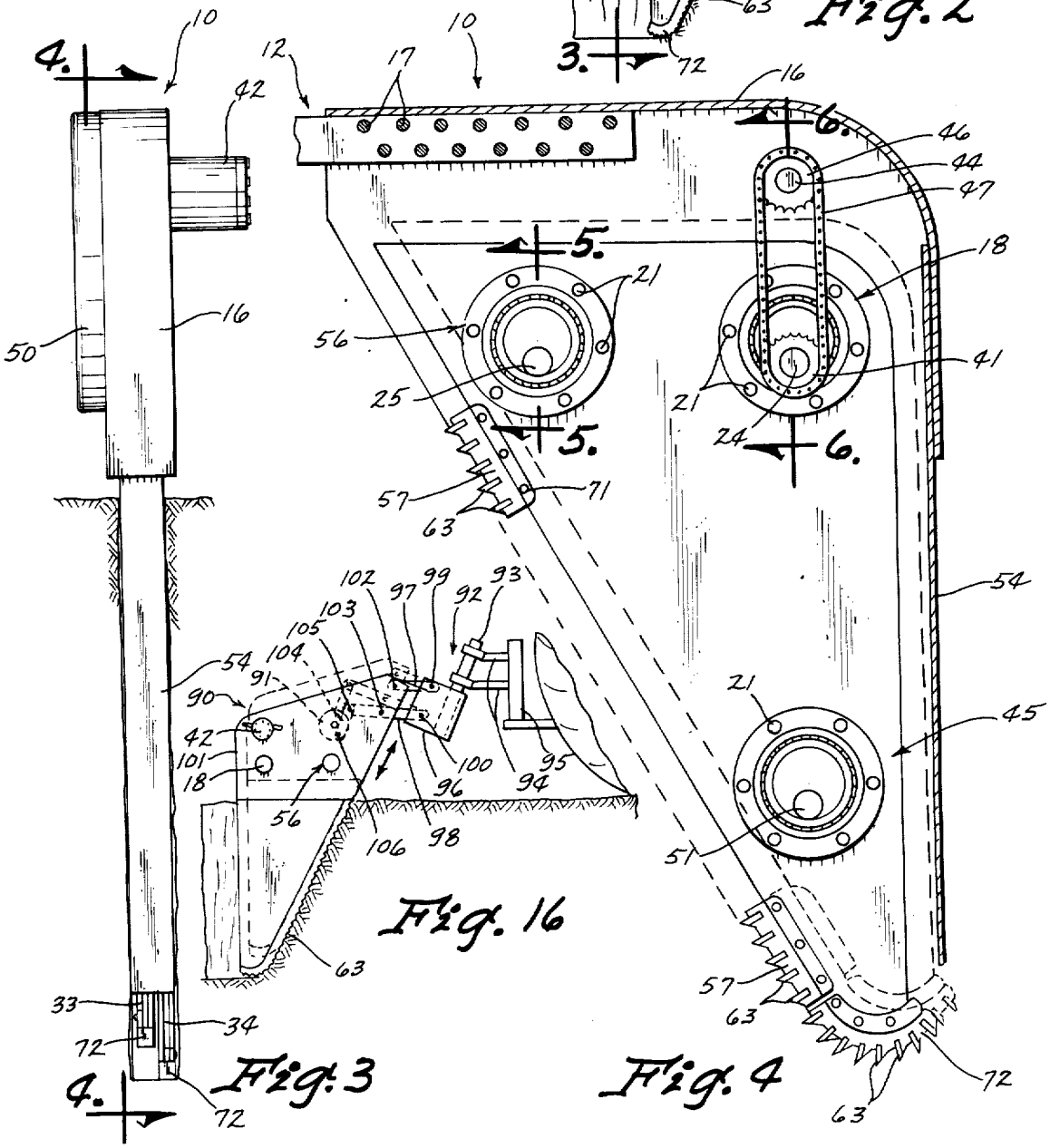
Fig. 16
Fig. 3
Fig. 4

ORBITAL TRENCH FORMING APPARATUS

BACKGROUND OF THE INVENTION

The present invention relates generally to a trenching apparatus and more particularly to a trenching apparatus for use in hard and discontinuous soils.

The most common type of trenching apparatus is the one having a continuous chain having digging teeth thereon. When the chain is driven, the teeth engage the earth and thereby cause the soil to be removed. One of the problems with the common chain type trencher is that it is not very effective in discontinuous soils, such as soils having rocks or the like therein. The common chain type trencher is also not very effective in very hard soils such as continuously rocky geological formations.

Another problem with the conventional chain type trenchers is that the moving parts thereof are all necessarily exposed, whereby creating a substantial safety hazard.

Additionally, it would also be desirable to be able to dig a ditch having a variable cross-sectional configuration, especially if the cross-sectional configuration was to be larger at the bottom than at the top. This trench configuration would be extremely useful for placing concrete footing, but such trenching configurations have not been possible by using only a conventional chain type trenching apparatus.

SUMMARY OF THE INVENTION

The present invention relates to a trenching device for dislodging and penetrating hard materials such as frost, blacktop, rocks, and other hard or discontinuous soils, more effectively than can be done by use of a common chain type apparatus. A first and second triangular shaped member having digging teeth attached to a leading edge thereof are rotated in an orbital fashion 180° out of phase and at a high r.p.m. so as to loosen the soil and remove it so as to form a trench.

An object of the present invention is to provide a trenching apparatus which is safer than the widely used chain type trenching devices.

Another object of the invention is to provide a trenching device which is suitable to form trenches in hard or discontinuous soils.

A further object of the invention is to provide a trenching apparatus which is suitable of producing a trench with non-parallel or contoured walls, and particularly one that is wider at the bottom than at the top thereof.

Still another object of the invention is to provide a trenching apparatus which will deliver the spoil to one side of a trench being formed.

A still further object of the invention is to provide an improved apparatus and method for attaching digging teeth to a trenching apparatus.

Other objects, advantages, and novel features of the present invention will become apparent from the following detailed description of the invention when considered in conjunction with the accompanying drawings.

BRIEF DESCRIPTION OF THE DRAWINGS

FIG. 1 is a side elevational view of the trenching apparatus of the present invention connected to a prime mover;

FIG. 2 is a side elevational view like FIG. 1, but showing the trenching apparatus in operation forming a trench;

FIG. 3 is a rear enlarged view of the trenching apparatus of the present invention taken along line 3—3 of FIG. 2;

FIG. 4 is an enlarged view showing the present invention partially in cross section and taken along line 4—4 of FIG. 3;

FIG. 16 shows another embodiment of the invention in side elevation and in operation.

DESCRIPTION OF THE PREFERRED EMBODIMENTS

Figure 5:
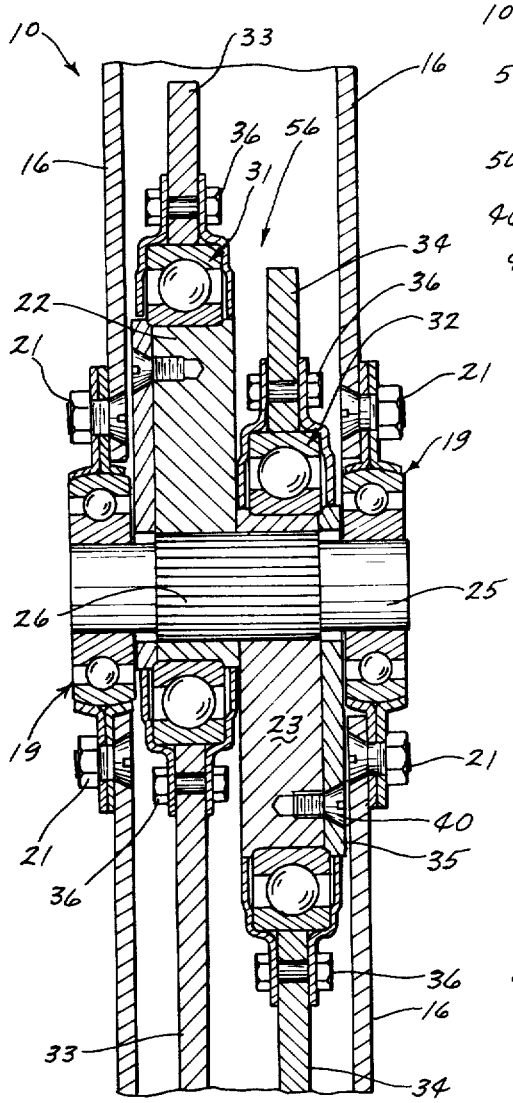
FIG. 5 is a cross-sectional view of one of the crank assemblies of the present invention taken along line 5—5 of FIG. 4.

Referring now to the drawings wherein like reference numerals designate identical corresponding parts throughout the several views, FIG. 1 shows the trenching apparatus 10 of the present invention connected to a prime mover 11 such as a tractor. FIGS. 1 and 2 show a mounting bracket structure which is pivotally attached to a three-point hitch of the tractor 11 along pivotal axes 13 and 14. Accordingly, the mounting bracket 12 is rigidly attached to the housing 16 by rivets or bolts 17.

Figure 6:
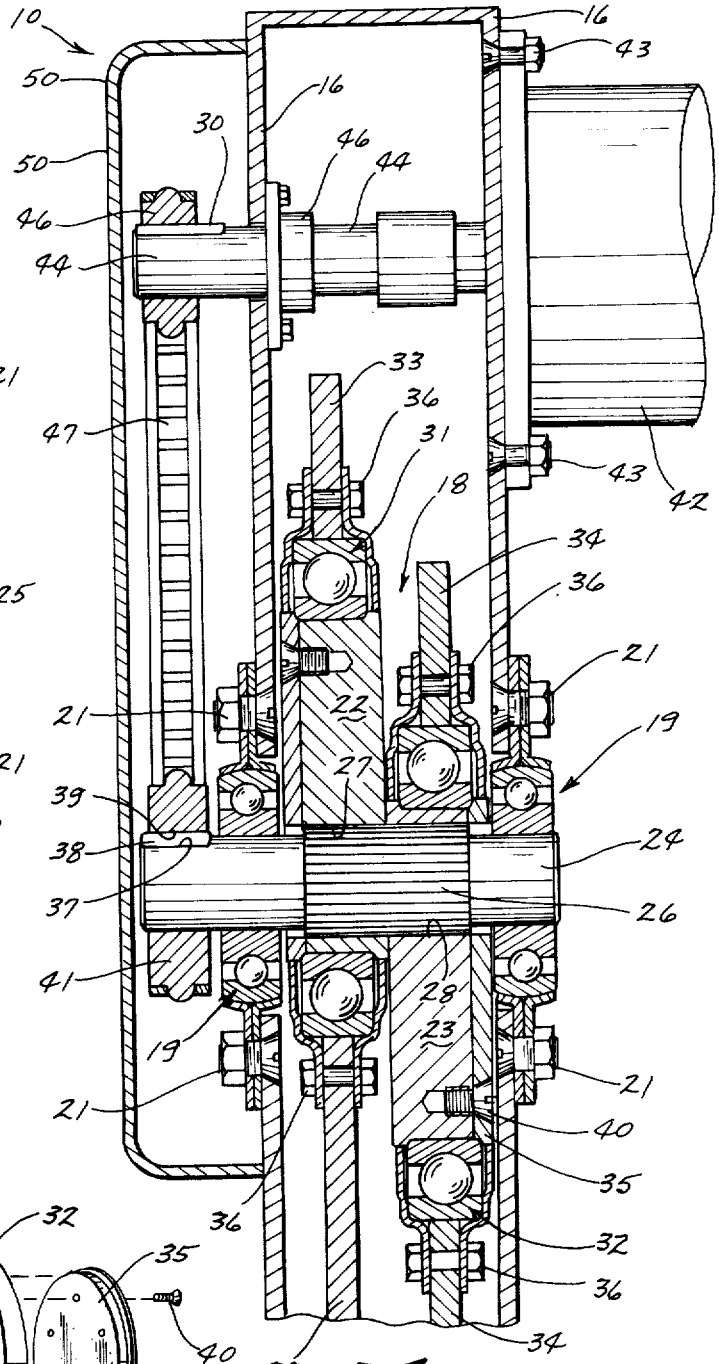
FIG. 6 is an enlarged cross-sectional view of a crank assembly and the driving section thereof taken along line 6—6 of FIG. 4.

The housing 16 has a first crank assembly 18 rotatably attached thereto by bearings 19, as can clearly be seen in FIG. 6. The bearings 19 are rigidly attached to the housing 16 by a plurality of nut and bolt structures 21. The first crank assembly 18 includes a first circular portion 22 and a second circular portion 23 which are secured to a shaft 24 having longitudinal splines 26 along a central portion thereof. The longitudinal splines 26, along with the fact that the openings 27 and 28 in the circular portions 22 and 23 are only very slightly larger than the diameter of the splined portion 26, tends to prevent these members 22 and 23 from rotating with respect to the shaft 24 once this slip fit is formed. The openings 27 and 28 can also include longitudinal serrations to aid in preventing the members 22 and 23 from rotating with respect to the shaft 24.

Bearings 31 and 32 are rigidly attached to first and second plate members 33 and 34, respectively, by nut and bolt structures 36. These bearing structures 31 and 32 allow the first and second portions 22 and 23 to rotate with respect to first and second plate members 33 and 34 in a relatively friction-free manner. It is not, of course, critical as to particular bearing structure used so that it will be understood to those skilled in this art that other types of bearings and other types of bearing mounting structures can be used in place of the bearings 19, 31 and 32.

One end of the shaft 24 has a slot 37 formed therein for reception of a pin 38 for the purpose of mating also with a slot 39 in the sprocket 41 to thereby prevent relative rotary motion between the shaft 24 and the sprocket 41. A hydraulic motor 42 is rigidly attached to the housing 16 by means of a plurality of nut and bolt devices 43 (FIG. 6). The hydraulic motor 42, which could be any other power source instead, has an output shaft 44 journaled in a bearing 46 which is, in turn, rigidly attached to the housing 16. The shaft 44 has a sprocket member 46 rigidly attached thereto by slot and key structure 30, which is similar to the fastening structure 37–39 of sprocket 41. A chain 47 is disposed around the sprockets 41 and 46 so that when the hydraulic motor 42 rotates the shaft 44, this rotary motion is transmitted to the sprocket 46 through the chain 47 and to the sprocket 41. This rotary motion of the sprocket 41, in turn, rotates the shaft 24. Rotation of the shaft 24 will, of course, rotate the first crank assembly 18, which rotation further causes a rotating or orbital motion to be imparted to the first and second plate members 33 and 34.

Figure 7:
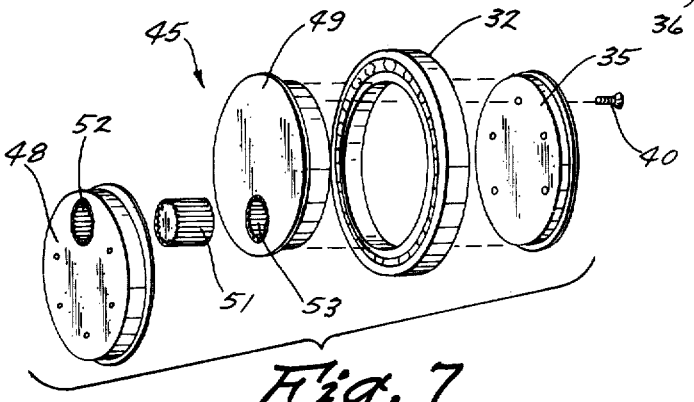
FIG. 7 is an exploded view of the timing crank assembly of the present invention.

It is to be understood that the first and second circular portions 22 and 23 are identical to the first and second portions 48 and 49 of the timing crank assembly 45 which is shown in FIG. 7. Only a portion of the timing crank assembly 45 is shown in FIG. 7; but, the timing crank assembly 45 is virtually identical to the first crank assembly 18 except for the fact that a stub shaft 51 is used instead of a shaft 24 as shown in FIG. 6. Consequently the timing crank assembly 45 is not connected to shield portion 54 of housing 16, but is merely mounted within it. The first and second circular portions 48 and 49 of the timing crank 45 are connected to the stub shaft 51 by fitting the stub shaft 51 into the openings 52 and 53 respectively of the first and second circular portions 48 and 49. The relationship of the parts 48, 49 and 51 are important in that the circular portions 48 and are maintained 180° out of phase. This relationship is also maintainined in the first and second crank assemblies 18 and 56. A bearing member 32 is to be received around the second circular portion 49 and held in place by a plate 35 and a screw 40, as is true with the bearing assembly 31 and 32 as shown in FIG. 6, and also of the bearing assemblies 31 and 32 as shown on the second crank assembly 56 in FIGS. 4 and 5.

The second crank assembly 56 is virtually identical to the first crank assembly 18 except for the fact that the shaft 25 of the second crank assembly 56 is shorter than the shaft 24 of the first crank assembly 18. This is true because there is no need for a driving sprocket to be attached to the shaft 25 of the second crank assembly 56. Accordingly, it can be seen that all of the other elements are identical and are identically numbered on the first and second crank assemblies 18 and 56, respectively.

It is noted that the main reason for using two oscillating members instead of one is to cancel out the primary unbalance forces created by the oscillating masses. This invention can also be extended to the use of three or more oscillating members, where space permits, so arranged on the cranks so that both the primary and the secondary forces are cancelled.

Referring back to FIG. 6, it can be seen that a shield 50 is attached to the housing 16 so as to keep dirt from contaminating the chain and sprocket structure 41, 46 and 47, and for safety reasons. Additionally, it has been found to be advisable to fill the cavity within the shield 50 with a heavy oil for lubricating the moving parts therein.

Figure 8:
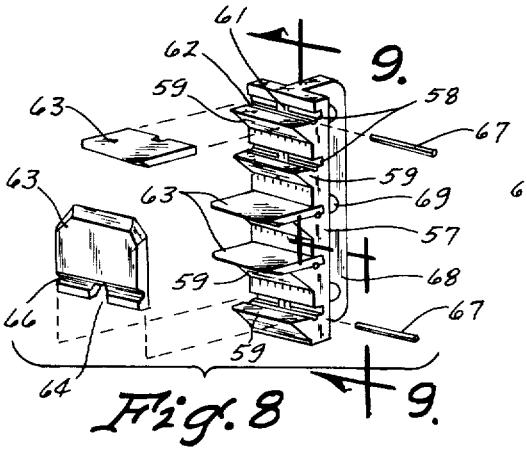
FIG. 8 is an exploded view of the tooth and tooth holding apparatus of the present invention.
Figure 9:
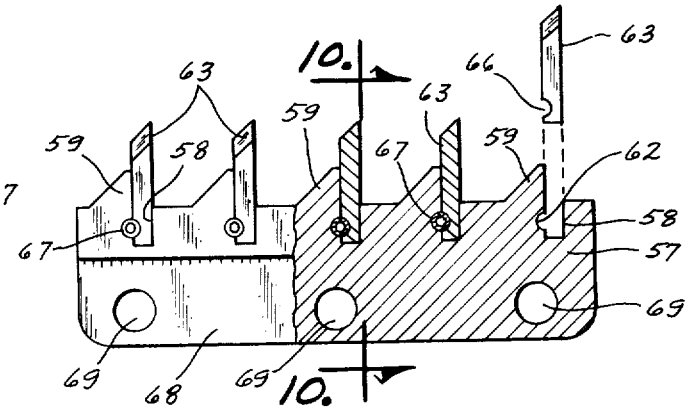
FIG. 9 is a partial cross-sectional view of the tooth and tooth holding apparatus taken along line 9—9 of FIG. 8.
Figure 10:
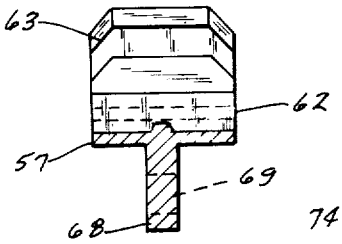
FIG. 10 is a cross-sectional view of the tooth and tooth holding apparatus taken along line 10—10 of FIG. 9.

Referring now to FIGS. 8, 9 and 10, a tooth holding bracket 57 is shown. The tooth holding bracket 57 has a plurality of slots 58 disposed therein and a plurality of projecting portions 58 attached thereto. A plurality of centrally located projections 61 are also located within the slot 58 for a reason which will be discussed below. A groove structure 62 is formed on each of the projecting portions 59 adjacent to the slots 58 and parallel therewith. A plurality of substantially flat teeth 63 are receivable within the slot 58 and the teeth 63 have a notch 64 which slips over the projection 61. A groove 66 is also disposed in the tooth 63 and this groove 66 mates with the groove 62 so that when the tooth is inserted in the slot 58, that a pin 67 can be received into both of the grooves 62 of a tooth holder 57 and into the groove 66 of a tooth 63 to thereby prevent movement into and out of the slot 58 in one direction and whereas the cooperating notch 64 of the tooth 63 and projection 61 of the tooth holder 57 prevent movement of the tooth 63 with respect to the tooth holder 57 in a direction perpendicular to that one direction.

A flange portion 68 of the tooth-holding bracket 57 has a plurality of holes 69 therein for the purpose of allowing the tooth holding bracket 57 to be bolted or riveted to the leading edge of either the first or second plate members 33 or 34 by the use of fastening devices 71 as is shown in for example in FIG. 4. The lowermost tooth holding bracket 72 is curved, rather than straight, as distinguished from the tooth holding bracket 57, but the tooth holding bracket 72 and teeth 63 are otherwise identical to the brackets 57 and its corresponding teeth 63.

When it is desired to form a trench with the trench forming apparatus 10 of the present invention, the hyraulic motor 42 is actuated to thereby the first crank assembly 18 and thereby cause the first and second plate members 33 and 34 to begin their orbital motion. The three-point hitch arrangement 12 of the tractor 11 is then actuated so that the trench forming apparatus 10 is moved from the position as shown in FIG. 1 to the position as shown in FIG. 2. The orbital motion of the members 33 and 34 is stabilized because of the three crank assemblies 18, 45 and 56, which crank assemblies are inner-related and coordinated so as to tend to move the plates 33 and 34 in an identical orbital path, 180° out of phase. This three-point crank arrangement provides the stability needed because of the magnitude of the forces acting on the first and second plate members 33 and 34. The crank assembly 18 is rotated about the shaft at approximately 1,000 r.p.m. or greater in the embodiment shown. Rotation speed of 1,000 r.p.m. on the present design can be changed to accommodate changed blade geometry and soil types. The high rotation speed in the present embodiment serves two purposes. The first is to develop high enough radial accelerations so that normally adhesive soils will not follow the orbiting blade but will be expelled tangentially upward, thus progressing towards the desired exit point from the trench. The second purpose is to accelerate the spoil to a velocity such that the natural angle of dynamic repose is overcome and spoil is moved upward out of the trench instead of sliding downward into it. It is apparent then that the minimum angular velocity is a function of the adhesive character of the soil to be trenched, the radius of the orbit, the angle of repose of the spoil, and the angle formed by the leading edge of the blade and the vertical.

Figure 11:
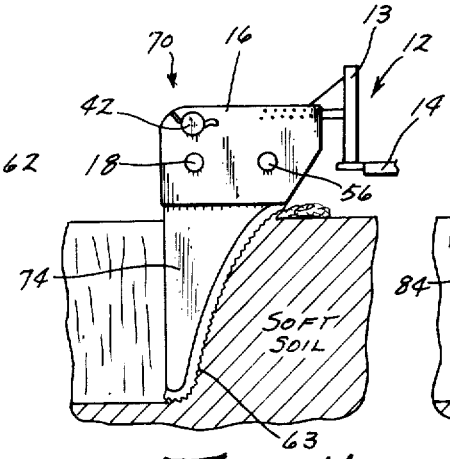
FIG. 11 shows another embodiment of the present invention for use in soft soils and shown in operation forming a trench.

Referring now to FIG. 11, a modified form of the invention is shown by the trench forming apparatus 70. This trench forming apparatus 70 is identical to the trench forming apparatus 10 disclosed above except for the configuration of the first and second plate members 33 and 34, the edge of which are indicated by the teeth 63 as shown in FIG. 11. This particular configuration is particularly useful and efficient for forming trenches in soft soil. As viewed in FIG. 11, the leading edge of members 33 and 34 as defined by the teeth 63 is somewhat concave in shape. The guard portion 74 of the housing 16 has also been changed accordingly to also be somewhat concave as viewed in FIG. 11.

Figure 12:
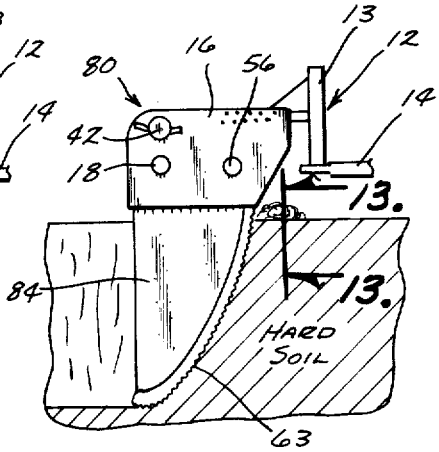
FIG. 12 is another embodiment of the present invention for use particularly in hard soils and shown in operation forming a trench.

Referring now to FIG. 12, another form of the present invention is shown by trenching apparatus 80. The trenching apparatus 80 is substantially identical to the trenching apparatus 10 referred to in detail above except that the first and second triangular plates 33 and 34 are changed in their configuration so as to form a somewhat convex leading surface as defined by the teeth 63 as shown in FIG. 12. The guard portion 84 of the housing 16 has also been changed accordingly to also be somewhat convex as viewed in FIG. 12. This trenching apparatus shown in embodiment 80 is particularly suited for use in very hard soils. Other configurations of plates 33 and 34 will suggest themselves to those skilled in this art, and this invention is not intended to be limited to only the configurations shown herein.

Figure 13:
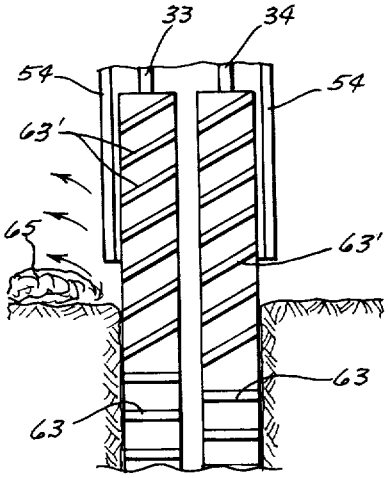
FIG. 13 is still another embodiment of the present invention showing slanted digging teeth for causing the soil to be thrown out one side of the trench being formed.

Referring now to FIG. 13, it can be seen that the topmost teeth 63' have been formed at an angle with respect to the lowermost teeth 63. Because of this configuration, the dirt 65 is thrown to one side as it exits the trench. The teeth on both of the plate members 33 and 34 are slanted in the same direction so as to throw the dirt on only one side of the trench. It it is desired to throw dirt or spoil on both sides of the trench, then the angle of the blade 63' on the leading edge of the member 34 would be angled in an opposite direction.

Figure 14:
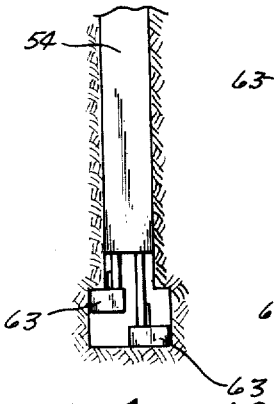
FIG. 14 shows still another embodiment of the present invention showing a plurality of digging teeth, the teeth at the bottom being wider than the teeth at the top of the trenching apparatus so as to form a trench which is wider at the bottom thereof than at the top.

Referring now to the embodiment of FIG. 14, it can be seen that the lowermost teeth 63 are wider than the uppermost teeth so that the trench will be wider at the bottom thereof than at the top thereof. This trench would probably need to be formed in a relatively hard soil so that the upper portion of the trench walls will not collapse into the enlarged lower portion.

Figure 15:
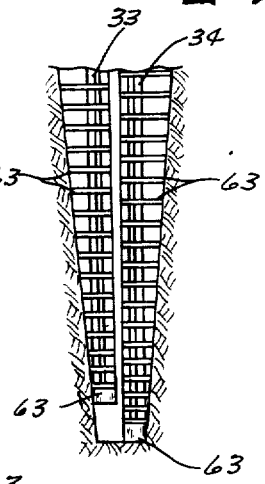
FIG. 15 shows still another embodiment of the present invention showing teeth which are progressively smaller at the bottom of the apparatus than at the top thereof to thereby form a trench which is wider at the top than at the bottom thereof.

Referring now to FIG. 15, a tooth arrangement 63 is provided wherein the lowermost teeth 63 are progressively smaller than the upper teeth so as to form a trench which is wider at the top than at the bottom thereof. The trench formed in FIG. 15 would be of a type requested by telephone companies because of the anticipated ease of backfilling and compaction.

Referring now to FIG. 16, still another embodiment of the present invention is illustrated. FIG. 16 shows a trenching apparatus 90 which is substantially identical to the trenching apparatus 10 as shown in FIGS. 1–7. The only major difference is the fact that the trenching apparatus 90 has a drive wheel 91 which is rotated either by a gear or chain (not shown) connected to one of the crank assemblies, such as crank assembly 56, or directly to the hydraulic motor 42. Alternatively, the drive wheel 91 could be driven by a separate motor, such as another hydraulic motor.

The mounting structure 92 of FIG. 16 is slightly different than the mounting structure shown in FIGS. 1 and 2, and includes a post 93 which is rigidly attached to a pair of arms 94, which are in turn rigidly connected to a post 95. The post 93 is adjustably connected to a bracket 96 having a pair of parallel arms 97 and 98 attached thereto. The parallel arms 97 and 98 are pivotally mounted to the bracket 96 at pivotal points 99 and 100, respectively. These parallel links 97 and 98 are also pivotally attached to the housing 101 at pivotal points 102 and 103, respectively. A link member 104 is pivotally attached to the other end of the crank link 98 at the point 105 and is pivotally attached to the crank 91 at the pivotal point 106. In operation, the present invention works exactly like a trenching apparatus 10 except that it has the additional feature that it moves up and down as shown by the solid and dashed lines in FIG. 16, in addition to the aforementioned oscillating motion of the plates 33 and 34. As the crank 91 rotates, this up and down reciprocating motion is passed on to the links 103 and 104 which cause the entire housing 101 to sequentially and continuously move up and down to thereby additionally aid in removing the loose dirt or spoil from the trench which is being formed.

Obviously many modifications and variations of the present invention are possible in light of the above teachings. It is therefore to be understood that, within the scope of the appended claims, the invention may be practiced otherwise than as specifically described.

I claim:

1. A trenching apparatus comprising:

a housing;

means for connecting said housing to a prime mover;

a first crank assembly rotatably mounted to said housing about a first axis, said first crank assembly having a first circular portion and a second circular portion, the axes of said first and second circular portions being different than said first axis and different from each other;

a second crank assembly rotatably mounted to said housing about a second axis, said second crank assembly including a third and a fourth circular portion, the axes of said third and fourth circular portions being different than said second axis and different from each other;

a timing crank assembly rotatably mounted about a third axis, said timing crank assembly including a fifth and a sixth circular portion, the axes of said fifth and sixth circular portions being different than said third axis and different from each other;

a first member having first, second and third circular openings therein and said first, third, and fifth circular portions being rotatably received respectively therein;

a second member having fourth, fifth and sixth circular openings therein and said second, fourth and sixth circular portions being rotatably received respectively therein;

a first set of teeth connected to a leading edge of said first member;

a second set of teeth connected to a leading edge of said second member; and means connected to said housing for rotating said first crank assembly about said first axis, and thereby rotating said first and second members.

2. The trenching apparatus as defined in claim 1 wherein said first and second members are generally triangular in shape.

3. The trenching apparatus as defined in claim 1 wherein said first, second and third axes are parallel and form a triangle when a line is drawn connecting the axes.

4. The trenching apparatus as defined in claim 2 wherein said first and second set of teeth are disposed along a leading side edge of said first and second members respectively.

5. The trenching apparatus as defined in claim 4 wherein first and second set of teeth extend along a bottom portion of said first and second members respectively.

6. The trenching apparatus as defined in claim 4 wherein said first and second set of teeth are substantially flat and are perpendicular to a straight line defining said leading side edge of said first and second members.

7. The trenching apparatus as defined in claim 4 wherein said first and second set of teeth include a lower subset of teeth which are perpendicular to a straight line defining said leading side edge of said first and second members and parallel with respect to each other; and an upper subset of teeth which are not perpendicular to said straight line defining said leading edge of said first and second members, said upper subset of teeth being substantially parallel with respect to each other to thereby cause the spoil to be thrown to one side of the trench being formed.

8. The trenching apparatus as defined in claim 4 wherein the teeth within said first set of teeth vary in width with respect to each other.

9. The trenching apparatus as defined in claim 8 wherein the teeth within said second set of teeth vary in width with respect to each other.

10. The trenching apparatus as defined in claim 9 wherein the lowermost teeth of said first and second set of teeth are wider than the uppermost teeth.

11. The trenching apparatus as defined in claim 8 wherein said first and second members have a top and bottom respectively and the teeth within said first set of teeth are progressively wider at the top and narrower at the bottom with respect to said leading side edge of the first member.

12. The trenching apparatus as defined in claim 11 wherein the teeth within said second set of teeth are progressively wider at the top and narrower at the bottom with respect to said leading side edge of the second member.

13. The trenching apparatus as defined in claim 1 wherein said leading edge of said first and second members id concave when viewed from the side thereof for use in soft soils.

14. The trenching apparatus as defined in claim 1 wherein said leading edge of said first and second members is convex when viewed from a side view thereof for use in hard soils.

15. The trenching apparatus as defined in claim 1 wherein the teeth of said first set of teeth are substantially flat and having a notch formed in the middle of the back end thereof, a groove disposed laterally across the back of one side of each of the teeth;

at least one tooth holding bracket attached to said leading edge of the first member, said tooth holding bracket having at least one slot therein; a projection of the approximate size of said notch disposed centrally in said slot and one side of said slot having a groove therein for mating with the groove of said tooth; and pin means for reception into holes formed by the mating grooves of said teeth and said tooth holding bracket for holding the teeth within said tooth holder.

16. The trenching apparatus as defined in claim 15 wherein said first and second set of teeth are mounted to said respective leading edges thereof by the use of identical structures.

17. The trenching apparatus as defined in claim 1 wherein said housing extends substantially around said first and second members and adjacent to but spaced from said leading edges of the first and second members.

18. The trenching apparatus as defined in claim 1 including means connected to said connecting means for reciprocating the housing.

19. The trenching apparatus as defined in claim 18 wherein said reciprocating means comprises a crank, a first link operatively connected to said crank and pivotally connected intermediate the ends thereof to said housing; a second link pivotally connected to said housing, said first and second links being pivotally connected to said connecting means whereby rotation of said crank reciprocates the housing.

* * * * *